US007494109B2

(12) United States Patent
van Meel et al.

(10) Patent No.: US 7,494,109 B2
(45) Date of Patent: Feb. 24, 2009

(54) WINCH FOR A SEGMENTED WIRE AND METHOD FOR OPERATING SAID WINCH

(75) Inventors: Marcel Jacobus Alfonsus van Meel, Sliedrecht (NL); Henricus Andreas Gerardes van Vessem, Vught (NL)

(73) Assignee: IHC Holland IE B.V., Sliedrecht (NL)

( * ) Notice: Subject to any disclaimer, the term of this patent is extended or adjusted under 35 U.S.C. 154(b) by 463 days.

(21) Appl. No.: 11/338,637

(22) Filed: Jan. 25, 2006

(65) Prior Publication Data

US 2007/0170296 A1 Jul. 26, 2007

(51) Int. Cl.
*B66D 1/26* (2006.01)

(52) U.S. Cl. ..... 254/278; 254/294

(58) Field of Classification Search ..... 254/278, 254/294

See application file for complete search history.

(56) References Cited

U.S. PATENT DOCUMENTS 1,689,016 A * 10/1928 Erlewine ..... 242/603
2,212,798 A * 8/1940 Sole ..... 242/603
2,513,095 A * 6/1950 Hunt ..... 226/194
3,960,340 A * 6/1976 Naas ..... 242/603
4,078,768 A * 3/1978 Krogstad et al. ..... 254/285
5,368,279 A * 11/1994 Ottemann et al. ..... 254/342
5,779,226 A * 7/1998 Wudtke ..... 254/278
5,829,736 A * 11/1998 Harken ..... 254/278
6,019,353 A * 2/2000 Atfield ..... 254/278
7,028,988 B2 * 4/2006 Scott ..... 254/277

* cited by examiner

*Primary Examiner*—Emmanuel M Marcelo
(74) *Attorney, Agent, or Firm*—Young & Thompson

(57) ABSTRACT

A winch installation comprises a rotatably supported main winch device, such as a drum, for winding and unwinding an elongated flexible object such as a wire or cable. At least one auxiliary winch device is rotatably supported so as to be rotatable around the main winch device, said at least one auxiliary winch device being provided with at least one aperture for allowing the flexible object to pass from the circumference of the main winch device and outwardly with respect to the circumference of the auxiliary winch device, and control means for controlling the rotations of said winch device.

22 Claims, 5 Drawing Sheets

WINCH FOR A SEGMENTED WIRE AND METHOD FOR OPERATING SAID WINCH

BACKGROUND OF THE INVENTION

1. Field of the Invention

The invention is related to a winch installation comprising a rotatably supported main winch device, such as a drum, for winding or unwinding an elongated flexible object such as a wire or cable. Such winch installation is widely known, and can be used for winding or unwinding all kinds of wires or cables, such as electric, hydraulic, pneumatic wires, steel cables, umbilicals of all kinds and so on. In so far as such objects are of a relatively flexible nature, the winding and unwinding process proceeds rather smoothly and usually does not give rise to particular problems.

2. Description of the Related Art

In specific applications, e.g. umbilicals which are provided with intermediate segments which are of a relatively rigid or stiff nature, the process of winding and unwinding can become more cumbersome. The relatively rigid segments are not flexible enough to follow the curved contour of the winch, which means that special precautions have to be taken when winding or unwinding such segmented umbilicals. Reference is made to U.S. Pat. No. 4,725,088, describing a lifting system according to which the relatively stiff segments are to be removed from the cable before winding said cable to the winch drum.

The disadvantage of such lifting system is obvious. Each time the stiff segments in question have to be dismounted from the cable upon winding said cable onto the winch drum, or have to be mounted onto the cable again upon unwinding thereof. Such process is cumbersome and time-consuming, and not fit for frequent winding and unwinding operations.

SUMMARY OF THE INVENTION

The object of the invention is therefore to provide in the first place a winch installation by means of which an elongated flexible object can be handled, even in case such object carries a relatively rigid element. Said object is achieved by means of a winch installation comprising at least one auxiliary winch device which is rotatably supported so as to be rotatable around the main winch device, said at least one auxiliary winch device being provided with at least one aperture for allowing the flexible object to pass from the circumference of the main winch device and outwardly with respect to the circumference of the auxiliary winch device, and control means for controlling the rotations of said winch devices.

In the winch installation according to the invention, first of all the flexible object, which extends through and past the circumference of the auxiliary winch device, is wound onto the main winch device while the auxiliary winch device remains stationary. As soon as the control means are detecting the approach of a rigid segment, the auxiliary winch device starts to rotate at the same rotational speed and in the same direction as the main winch device. The start of this rotational movement of the auxiliary winch device is to be selected in such a way that eventually the rigid segment comes to lie in an aperture in the circumference of said auxiliary winch device. As said rigid segment, while stretching over the aperture in question, is not subjected to bending forces, having regard to the absence of parts of the auxiliary winch device at the location of said aperture, it can be simply wound onto said auxiliary winch device. It is to be noted of course that the circumferential dimension of said aperture should be at least of the same longitudinal dimension of the rigid segment.

While continuing the rotation of the main winch device and the auxiliary winch device, subsequently the rest of the elongated flexible object is wound onto the circumference of the auxiliary winch device. In this connection, it is of importance that the main winch device and the auxiliary winch device are rotatable independently from each other, be it that their mutual rotations have to be tuned with respect to each other by the control means so as to guarantee a proper accommodation of the rigid segment onto the circumference, in particular the aperture therein, of the auxiliary winch device.

The auxiliary winch device can be carried out in several ways, provided there is at least one aperture as discussed before. The auxiliary winch device may comprise several auxiliary winch elements which are distributed around the main winch device, each pair of neighbouring auxiliary winch elements enclosing an aperture. For example, three circumferentially regularly spaced auxiliary winch elements may be provided, each enclosing an aperture having a specific dimension in circumferential direction. However, different number of winch elements may be provided as well. With the aim of providing a proper support surface for the elongated flexible object, the auxiliary winch elements may have a convexly curved outer surface.

According to a further possibility, at least two auxiliary winch devices are provided, a second or further auxiliary winch device being rotatable around a first auxiliary winch device, said second or further auxiliary winch device being provided with at least one aperture for allowing the elongated flexible object to pass from the circumference of the first auxiliary winch device or from the main winch device and outwardly with respect to the circumference of the second auxiliary winch device. In this embodiment, a wire can be wound which has two (or more) rigid objects along its length.

The invention is also related to the combination of a winch installation as described before, and a segmented elongated flexible object having a flexible elongated member, such as a wire or cable, and at least one relatively rigid member on both ends of which the flexible elongated member extends. In this connection, the length of the relatively rigid member is at most equal to the circumferential or length dimension of an aperture of the auxiliary winch device. Furthermore, a sensor may be provided for detecting the position of the relatively rigid member with respect to the auxiliary winch device.

Additionally, the invention is related to a method for winding an elongated flexible object onto a winch installation as described before, said elongated flexible object having an elongated flexible member with a relatively rigid member between its ends, comprising the steps of:

- providing a main winch device onto which the elongated flexible member is connected,
- providing an auxiliary winch device which surrounds the main winch device, said auxiliary winch device having at least one aperture through which the elongated flexible member extends,
- winding the flexible member onto the main winch device while keeping the auxiliary winch device stationary,
- detecting the presence of the relatively rigid element in relation to the winch installation,
- upon establishing a specific distance between said relatively rigid member and the winch installation, making the auxiliary winch device rotate in the same direction as the main winch device,
- making the relatively rigid member become lodged in an aperture of the auxiliary winch device.

The start of the rotations of the auxiliary winch device should be tuned with respect to the distance between the rigid segment and the circumference of said auxiliary winch device, in particular the distance between said rigid segment and the aperture in which said rigid segment has to be accommodated. To that end, the method according to the invention comprises the step of:

upon establishing a specific distance between said relatively rigid member and the winch installation, making the main winch device rotate at the same rotational speed as the auxiliary winch device.

Furthermore, the elongated flexible member may have a leading end and a trailing end between which ends the relatively rigid member has been accommodated. In this connection, the method according to the invention may comprise the step of:

winding the leading end of the elongated flexible member onto the main winch device, after making the relatively rigid member become lodged in the aperture of the auxiliary winch device, winding the trailing end of the elongated flexible member onto the auxiliary winch device.

As addressed before, the invention is not only related to a method of winding the elongated flexible object onto the winch installation, but also to a method for unwinding said elongated flexible object. Said winch installation is provided with a main winch device onto which the leading end of the elongated flexible object is wound, and an auxiliary winch device which surrounds the main winch device, said auxiliary winch device having at least one aperture through which the elongated flexible member extends, said elongated flexible member having a relatively rigid member between its ends, said relatively rigid member extending over an aperture, and wherein a trailing end of the elongated flexible member has been wound onto the auxiliary winch device. In this connection, the method according to the invention comprises the steps of.

unwinding the trailing end of the elongated flexible member from the auxiliary winch device by rotating the main winch device in the same direction and preferably at the same rotational speed as the auxiliary winch device, removing the relatively rigid member from the aperture over which it extends after unwinding the trailing end of the elongated flexible member from the auxiliary winch device, unwinding the leading end of the elongated flexible member from the main winch device while rotating the main winch device and while the auxiliary winch device is stationary.

Moreover, a further auxiliary winch may be provided around the first auxiliary winch device. Said further auxiliary winch device has an aperture as well, in such a way that a further rigid member of the elongated flexible element can be accommodated in the aperture of said further auxiliary winch device. Correspondingly, more or further auxiliary winch devices may be provided, depending on the number of rigid members of the elongated flexible element. A further advantage of the winch installation is that a cable can be wound relatively quickly by using the outer auxiliary winch device.

BRIEF DESCRIPTION OF THE DRAWINGS FIGURES

The invention will now be described further with reference to an embodiment shown in the drawings.

FIGS. 3*a-f* show several consecutive steps in winding a segmented wire onto the winch installation according to the invention.

Figure 4:
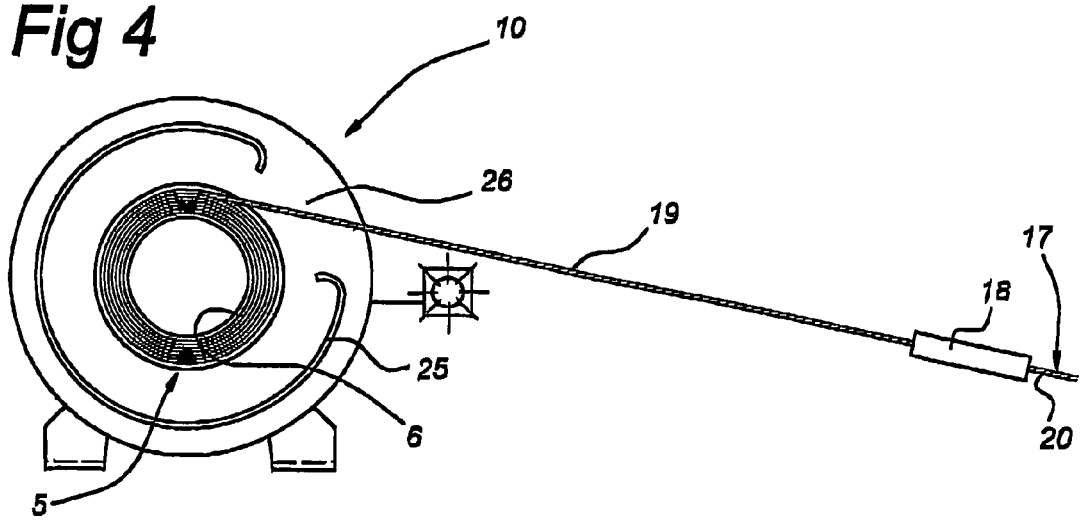

FIG. 4 shows an alternative embodiment of a winch installation according to the invention.

Figure 5:
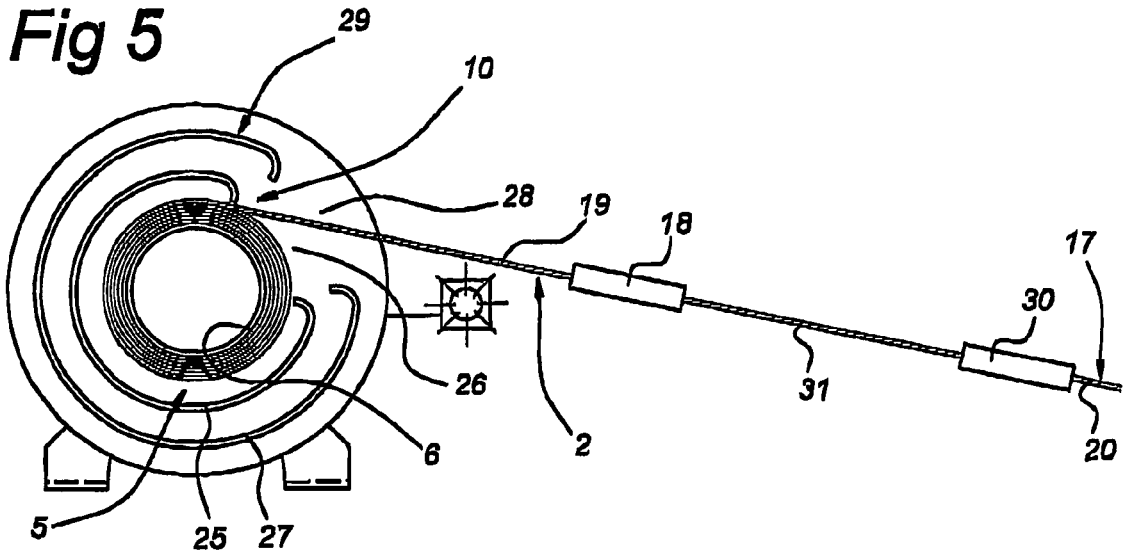

FIG. 5 shows a further alternative embodiment of a winch installation according to the invention.

DETAILED DESCRIPTION OF THE PREFERRED EMBODIMENTS

Figure 1:
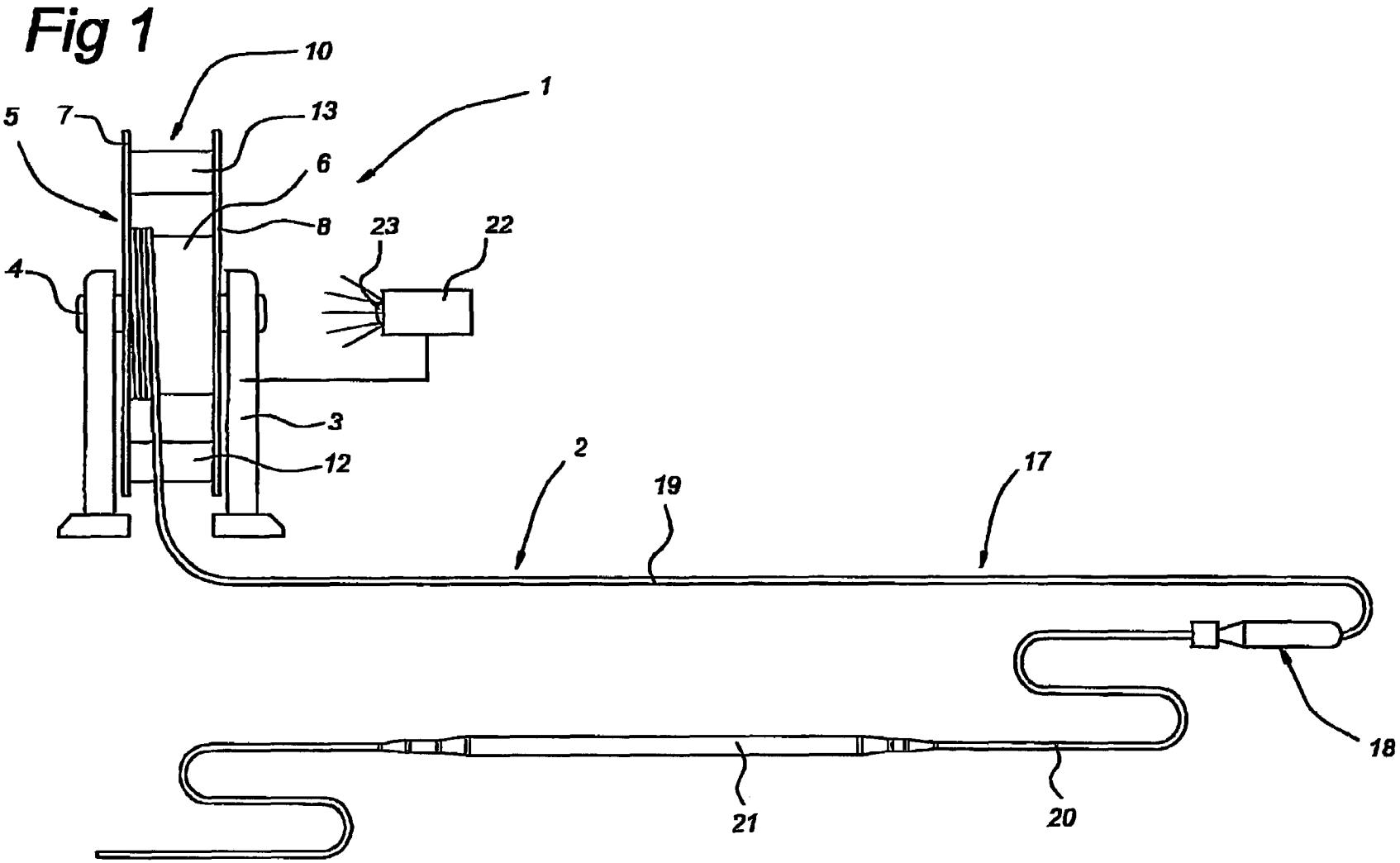
FIG. 1 shows the general layout of a winch installation in combination with a segmented wire, such as an umbilical.
Figure 2:
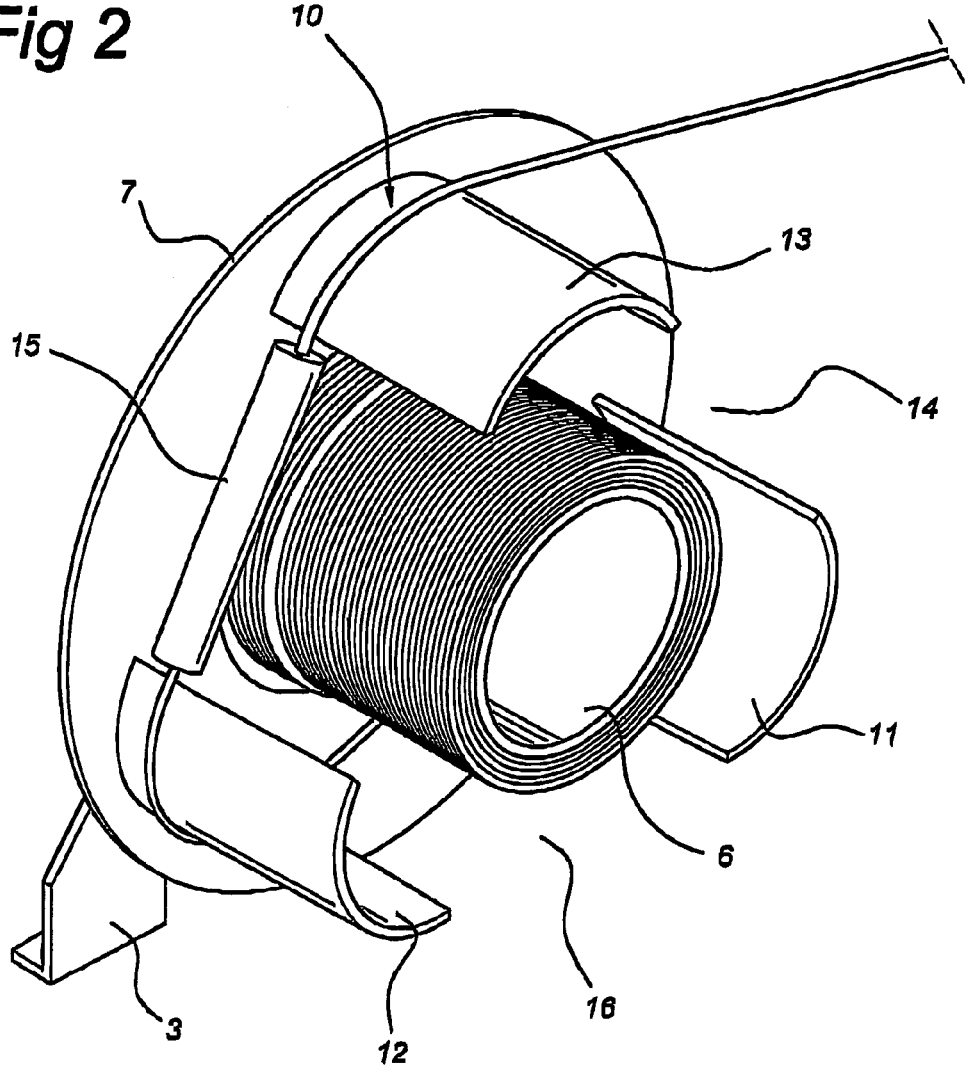
FIG. 2 shows part of the winch installation, in combination with a segmented wire, according to the invention.

FIGS. 1 and 2 show a winch installation, generally denoted with reference numeral 1, onto which the segmented wire, generally denoted by reference numeral 2, has been wound partially. The winch installation 1 comprises a support 3 provided with a shaft 4 onto which the main winch device 5, provided with a drum 6, has been rotatably supported. Furthermore, the winch installation 1 comprises two outwardly extending flanges 7, 8 which are interconnected by the auxiliary winch device 10. Said auxiliary winch device 10 consists of three auxiliary winch device elements 11, 12, 13 which are regularly spaced around the drum 6 and which, in pairs, enclose the apertures 14, 15, 16.

The segmented wire or elongated flexible object 2 consists of a flexible elongated member 17 as well as the relatively rigid member 18. The flexible elongated member 17 thus consists of a leading end 19 and a trailing end 20, which are located, in the winding direction, before the rigid member 18 respectively after the rigid member 18. The trailing end 20 has, in this example, a further flexible body 21 mounted onto it. Furthermore, a control device 22 has been provided, which is being fed with signals from the sensor 23 which monitors the approach of the rigid member 18.

Figure 3A:
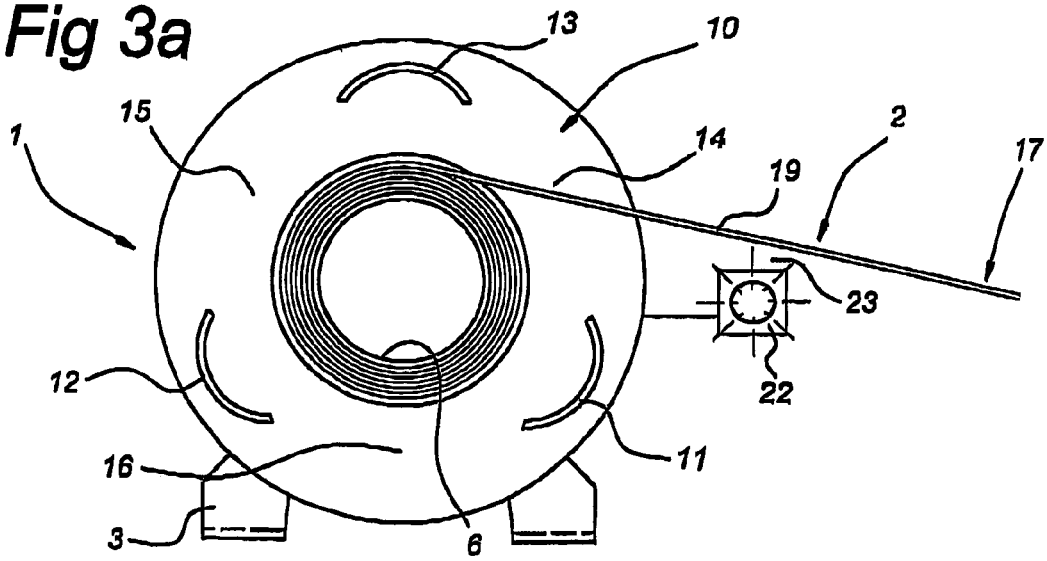

Now referring to the steps of winding an elongated flexible object 2 onto the winch installation 1, as shown in FIG. 3*a-f*, first of all the leading end 19 of the elongated flexible member 17 is wound onto the drum 6 while the auxiliary winch device 10 is stationary. This means that said leading end 19 passes through the aperture 14 as defined by the auxiliary winch elements 11, 13. As long as the sensor 23 of the control device 22 monitors the presence of said leading end 19, the winching operation of the drum 6 continues, as shown in FIG. 3*a*.

Figure 3B:
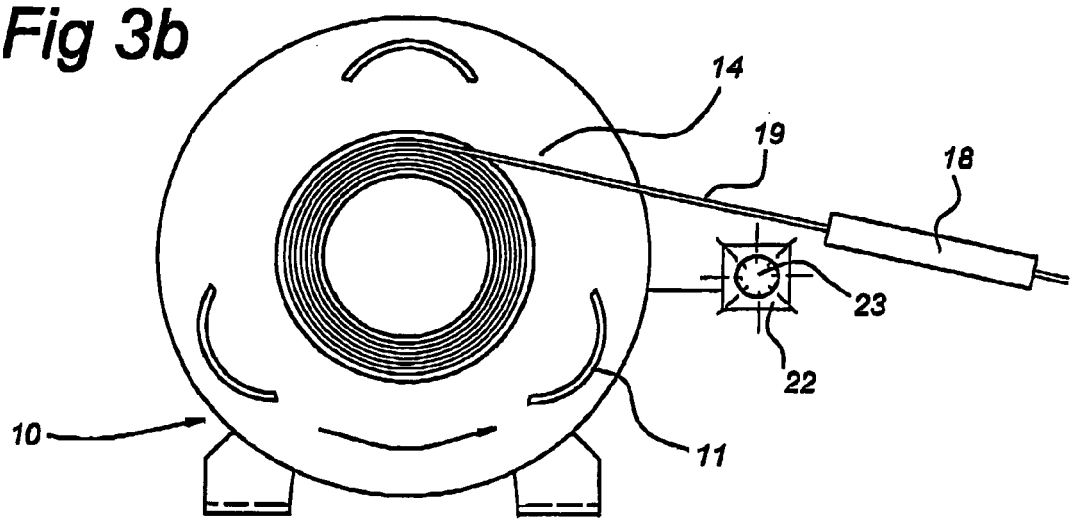
Figure 3C:
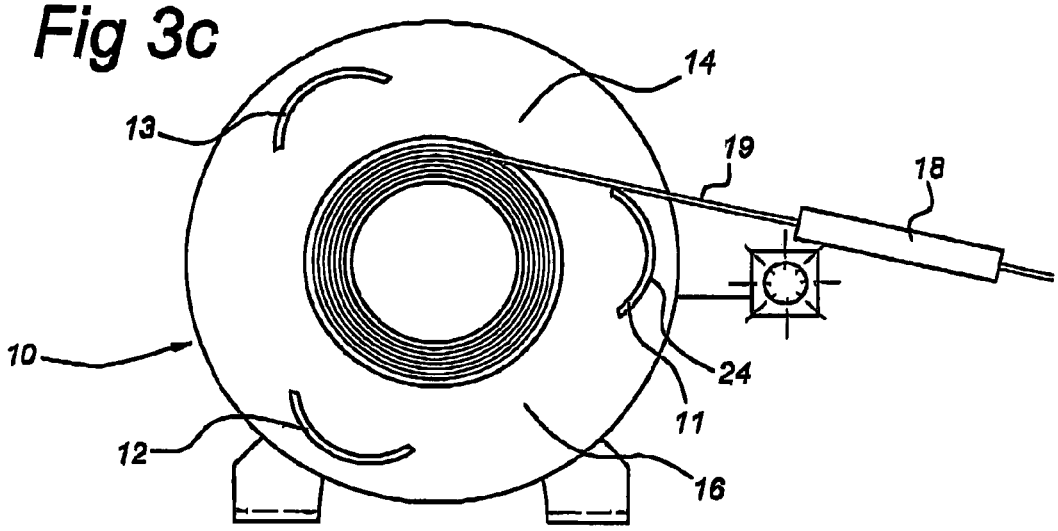
Figure 3D:
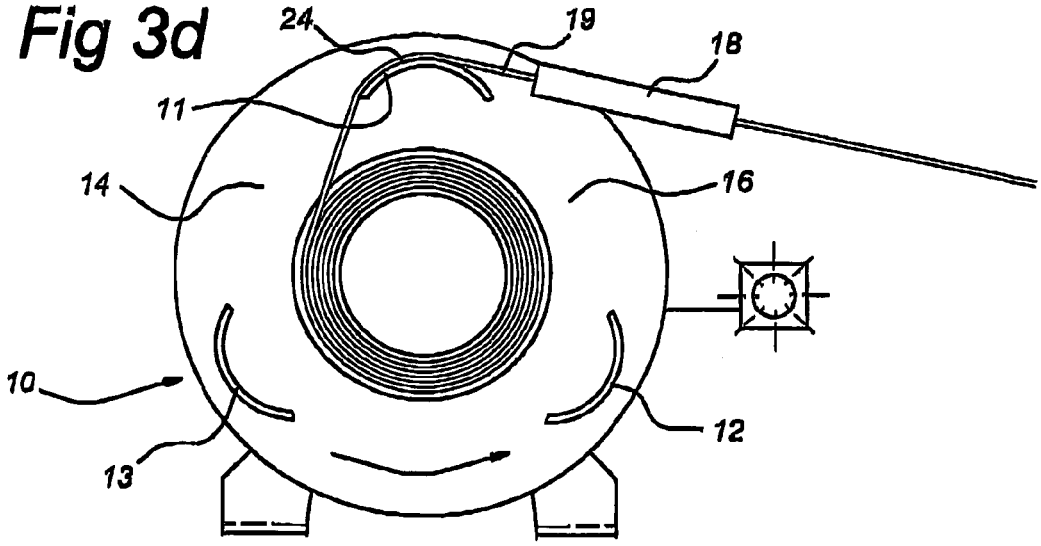
Figure 3E:
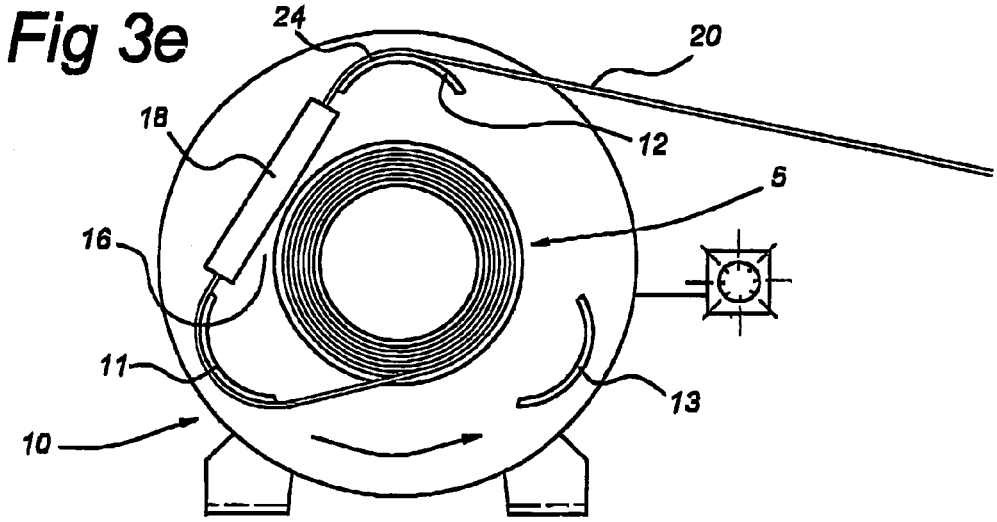
Figure 3F:
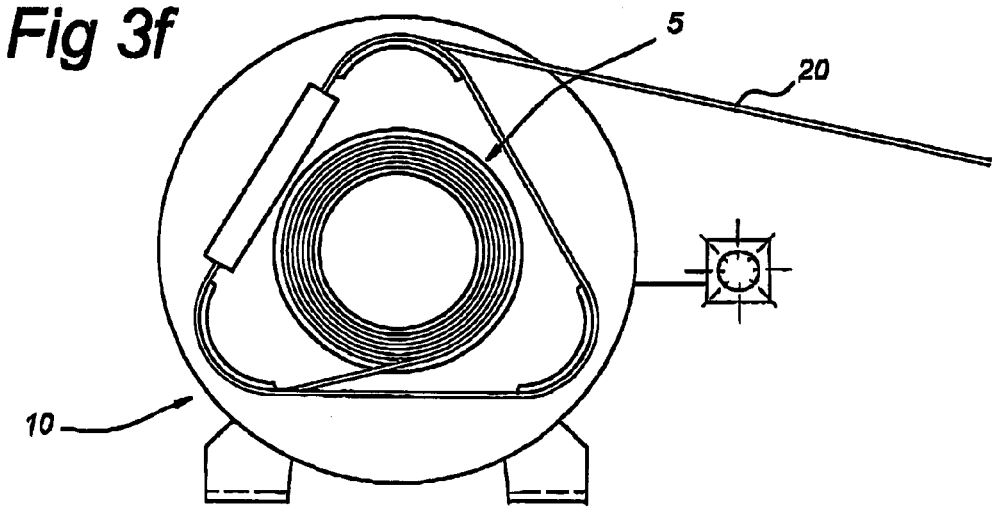

Now turning to FIG. 3*b*, upon detection of the rigid element 18, the control device 22 emits a signal for making the auxiliary winch device 10 come into rotation. As a result, as shown in FIG. 3*c*, the auxiliary winch element approaches the leading end 19, whereupon said leading end 19 comes to bear onto the curved outer circumference 24 of said auxiliary winch element 11. As shown in FIG. 3*d*, upon further rotation of the auxiliary winch device 10, the leading end is curved around said outer circumference 24 of the auxiliary winch element 11. Gradually, the rigid member 18 becomes lodged in the aperture 16 which is located between the auxiliary winch elements 11 and 12, until the trailing end 20 of the elongated flexible member 17 comes to bear onto the outer curved circumference of the auxiliary winch element 12, as shown in FIG. 3*e*.

The rigid member 18 now stretches the distance of the aperture 16 between the auxiliary winch elements 11, 12, without being subjected to any forces which try to impose a curved form onto said rigid member 18. Now the rotation of the auxiliary winch device 10 and the main winch device 5 is continued, making the trailing end 20 become more and more wound onto the auxiliary winch elements 11, 12, 13.

In the process of unwinding the elongated flexible object 2 from the winch installation 1, the order of the steps is reversed from 3*f* and so on up to 3*a*.

The embodiment of FIG. 4 comprises a different auxiliary winch device 10, having a single drumlike auxiliary winch element 25, defining only one aperture 26. Said auxiliary winch device 10 is set into rotation once the length of the leading end 19, stretching from the drum 6 and to the rigid member 18, has become of such dimension that said rigid member 18 just becomes lodged into the aperture 26 after said leading end 19 has been wound around the drumlike auxiliary winch element and 25.

The embodiment of FIG. 5 comprises a further auxiliary winch device 29, arranged around the auxiliary winch device 10. Said auxiliary winch device 29, in the embodiment shown, also has one aperture 28 which is accommodated in the drumlike auxiliary winch element 25. The cable or wire 2 now has a further rigid member 30, an intermediate part 31 of the elongated flexible element 2 stretching between both rigid members 18, 30. After the first rigid member 18 has been accommodated in the aperture 26 of the drumlike auxiliary winch element 25, and the intermediated part 31 of the elongated flexible member has been wound onto said drumlike auxiliary winch element 25, the further drumlike auxiliary winch element 27 is set into rotation in such a way that the further rigid element 30 becomes lodged in the aperture 28 of said drumlike auxiliary winch element 27. Finally, the trailing end 20 of the elongated flexible member 2 is wound onto said drumlike further auxiliary winch element 27. Unwinding the elongated flexible member 2 is carried out in an opposite order.

The invention claimed is:

1. A winch installation (1), comprising:

a rotatably supported main winch device (5), for winding or unwinding an elongated flexible object (2);

at least one auxiliary winch device (10) which is rotatably supported so as to be rotatable around the main winch device (5), said at least one auxiliary winch device (10) being provided with at least one aperture (14-16, 26) for allowing the flexible object (2) to pass from the circumference of the main winch device (5) and outwardly with respect to the circumference of the auxiliary winch device (10); and control means (22) for controlling the rotations of said winch devices (5, 10).

2. The winch installation (1) according to claim 1, wherein the main winch device (5) and auxiliary winch device (10) are independently rotatable with respect to each other.

3. The winch installation (1) according to claim 2, wherein an auxiliary winch device (10) comprises several auxiliary winch elements (11-13) which are distributed around the main winch device (5), each pair of neighbouring auxiliary winch elements (11-13) enclosing an aperture (14-16).

4. The winch installation (1) according to claim 1, wherein the auxiliary winch device (10) comprises several auxiliary winch elements (11-13) which are distributed around the main winch device (5), each pair of neighboring auxiliary winch elements (11-13) enclosing an aperture (14-16).

5. The winch installation according to claim 4, wherein the auxiliary winch elements (11-13) have a convexly curved outer surface.

6. The winch installation according to claim 5, wherein three circumferentially regularly spaced auxiliary winch elements (11-13) are provided, each enclosing an aperture (14-16) having a specific length dimension.

7. The winch installation according to claim 4, wherein three circumferentially regularly spaced auxiliary winch elements (11-13) are provided, each enclosing an aperture (14-16) having a specific length dimension.

8. The winch installation according to claim 1, wherein at least two auxiliary winch devices (10, 29) are provided, a second or further auxiliary winch device (29) being rotatable around the first auxiliary winch device (10), said second or further auxiliary winch device (29) being provided with at least one aperture (28) for allowing the elongated flexible object (2) to pass from the circumference of the first auxiliary winch device (10) or from the main winch device (5) and outwardly with respect to the circumference of the second auxiliary winch device (29).

9. The winch installation according to claim 1, wherein the rotatably supported main winch device (5) is a drum.

10. The winch installation according to claim 1, wherein the elongated flexible object is wire or cable.

11. A combination including a winch installation (1), comprising:

a rotatably supported main winch device (5) for winding or unwinding an elongated flexible object (2);

at least one auxiliary winch device (10) which is rotatably supported so as to be rotatable around the main winch device (5), said at least one auxiliary winch device (10) being provided with at least one aperture (14-16) for allowing the flexible object (2) to pass from the circumference of the main winch device (5) and outwardly with respect to the circumference of the auxiliary winch device (10);

control means (22) for controlling the rotations or all winch devices (5, 10), and the segmented elongated flexible object (2) having a flexible elongated member (17); and at least one relatively rigid member (18) on both ends of with the flexible elongated member (17) extends, the length of the relatively rigid member (18) being at most equal to the circumferential dimension of an aperture (14-16), 26) of the auxiliary winch device (10).

12. The combination according to claim 11, comprising at least one further auxiliary winch device (29) which is rotated to be supported so as to be rotatable around the main winch device (5) and the at least one auxiliary winch device (10), said further auxiliary winch device (29) being provided with at least one aperture (28) for allowing the flexible object (2) to pass from the circumference of the main winch device (5) and/or from the circumference of the at least one auxiliary winch device (10) and outwardly with respect to the circumference of the further auxiliary winch device (29), and the segmented elongated flexible object (2) having a flexible elongated member (17), such as a wire or cable, and at least two relatively rigid members (18, 30) on both ends of which relatively rigid members (18, 30) the flexible elongated member (17) extends, the length of the at least second relatively rigid member (13) being at most equal to the circumferential dimension of an aperture (28) of the at least second auxiliary winch device (30).

13. A method of operating the combination according to claim 12 for winding an elongated flexible object (2) onto the winch installation (1), wherein the elongated flexible member (2) has an intermediate part (31) stretching between at least two relatively rigid members (18, 30), comprising the steps of:

winding the elongated flexible member (2) onto the main winch device (5) or the at least one auxiliary winch device (10) while keeping the further auxiliary winch device (29) stationary;

detecting the presence of the at least one further relatively rigid element (13) in relation to the winch installation (1);

upon establishing a specific distance between said at least one further relatively rigid member and the winch installation (1), making the at least one further auxiliary link device (10) rotate so the same direction as the other winch devices (5, 10); and making the at least one further relatively rigid member (30) become lodged in an aperture 28 of the at least one further auxiliary winch device (29).

14. The method according to claim 13, further comprising the step of:

upon establishing a specific distance between said at least one further relatively rigid member (30) and the winch installation (1), making the other winch devices (5, 10) rotate at the same speed as the at least one fatter auxiliary device (29).

15. The method according to claim 13, further comprising the steps of:

winding the leading end (19) of the elongated flexible member (2) onto the main winch device (5);

after making the relatively rigid member (18) become lodged in the aperture (14-16, 26) of the at least one auxiliary winch device (10), winding the intermediate part (31) of the elongated flexible member (2) onto the at least one auxiliary winch device (10); and after making the at least one further relatively rigid member (30) become lodged in the aperture (28) of the at least one further auxiliary winch device (29), winding the trailing end (20) of the elongated flexible member (2) onto the at least one further auxiliary winch device (29).

16. A method of operating the combination of claim 12 for unwinding an elongated flexible member (17) from the installation (1), wherein the elongated flexible member (2) has an intermediate part (31) stretching between at least one relatively rigid member (18) and at least one further rigid member (29), said winch installation (1) being provided with a main winch device (5) onto which the leading end (19) of the elongated flexible object (2) has been wound, at least one auxiliary winch device (10) which surrounds the main winch device (5), said at least one auxiliary winch device (10) having at least one aperture (14-16, 26) through which the elongated flexible member (2) extends, a relatively rigid member (18) extending over said at least one aperture (14.16, 26) and wherein the intermediate part (31) of the elongated flexible member (2) has been wound onto the at least one auxiliary winch device (10), at least one further auxiliary winch device (29) which surrounds the at least one auxiliary winch device (10), said at least one further auxiliary winch device (29) having at least one aperture (28) through which the elongated flexible member (2) extends, a further relatively rigid member (13) extending over said at least one aperture (28) of the at least one further auxiliary winch device (29), and a trailing end (20) of the elongated flexible member (2) has been wound onto the at least one further auxiliary winch device (29), comprising the steps of:

unwinding the trailing end (20) of the elongated flexible member (2) from the at least one further auxiliary winch device (29) by rotating the main winch device (5), the at least one auxiliary winch device (10) and at least one further auxiliary winch device (29);

removing the at least one further rigid member (30) from the aperture (28) over which It extends after unwinding the trailing end (20) of the elongated flexible member (2) from the at least one further auxiliary winch device (29);

unwinding the intermediate part (31) from the at least one auxiliary winch device (10) by rotating the main winch device (5) and the at least one auxiliary winch device (10) while the at least one further auxiliary winch device (29) is kept stationary;

removing the at least one rigid member (18) from the aperture (14-16, 26) over which It extends after unwinding the intermediate part (31) of the elongated flexible member (2) from the at least one auxiliary winch device (10); and unwinding the leading end (19) of the elongated flexible member (2) from the main winch device (5) while rotating the main winch device (5) while the at least one auxiliary winch device (10) and the at least one further auxiliary winch device (29) are kept stationary.

17. The combination according to claim 12, comprising a sensor (23) for detecting the position of the relatively rigid member (18) with respect to the auxiliary winch device (10).

18. The combination according to claim 11, comprising a sensor (23) for detecting the position of the relatively rigid member (18) with respect to the auxiliary winch device (10).

19. A method of operating the combination according to claim 11 for winding an elongated flexible object (2) onto the winch installation (1), said at least one elongated flexible object (2) having the elongated flexible member (17) with the relatively rigid member (18) between its ends, comprising the steps of:

winding the elongated flexible member (2) onto the main winch device (5) while keeping the auxiliary winch device (10) stationary;

detecting the presence of the relatively rigid element (18) in relation to the winch installation (1);

upon establishing a specific distance between said relatively rigid member (18) and the winch installation (1), making the auxiliary winch device (10) rotate in the same direction as the main winch device (5); and making the relatively rigid member (18) become lodged in the aperture (14-16, 26) of the auxiliary winch device (10).

20. The method according to claim 19, further comprising the step of:

upon establishing a specific distance between said relatively rigid member (18) and the wince installation (1), making the main winch device (5) rotate at the same speed as the auxiliary winch device (10).

21. The method according to claim 19, wherein the elongated flexible member (2) has a leading end (19) and a trailing end (20) between which ends the at least one relatively rigid member (18) has being accommodated, further comprising the steps of:

winding the leading end (19) of the elongated flexible member (2) onto the main winch device (5); and after making the relatively rigid member (18) become lodged in the aperture (14-16, 26) of the auxiliary winch device (10), winding the trailing end (20) of the elongated flexible member (2) onto the auxiliary winch device (10).

22. A method of operating the combination of claim 11 for unwinding an elongated flexible member (2) from the winch installation (1), said winch installation (1) being provided with a main winch device (5) onto which the leading end (19) of the elongated flexible object (2) is wound, and an auxiliary winch device (10) which surrounds the main winch device (5), said auxiliary winch device (10) having at least one aperture (14-16, 26) through which the elongated flexible member (2) extends, said elongated flexible member (2) having a relatively rigid member (18) between its ends, said relatively rigid member (18) extending over said at least one aperture (14-16, 26) and wherein a trailing end (20) of the elongated flexible member (2) has been wound onto the auxiliary winch device (10), comprising the steps of:

unwinding the trailing end (20) of the elongated flexible member (2) from the auxiliary winch device (10) by rotating the main winch device (5) and the auxiliary winch device (10);

removing the relatively rigid member (18) from the aperture (14-16, 26) over which it extends after unwinding the trailing end (20) of the elongated flexible member (2) from the auxiliary winch device (10); and unwinding the leading end (19) of the elongated flexible member (2) from the main winch device (5) while rotating the main winch device (5) and while the auxiliary winch device (10) is stationary.

* * * * *